United States Patent [19]

Grothe et al.

[11] Patent Number: 4,719,960

[45] Date of Patent: Jan. 19, 1988

[54] APPARATUS FOR CONNECTING A DUMMY STRIP TO THE LEADING END OF A CASTING IN THE START-UP OF CONTINUOUS CASTING OF STRIP METAL

[75] Inventors: Horst Grothe, Kaarst; Peter Boese, Moers; Manfred Kolakowski, Erkrath; Hermann Lax, Düsseldorf, all of Fed. Rep. of Germany

[73] Assignees: SMS Schloemann-Siemag AG., Dusseldorf; Thyssen Aktiengesellschaft, Duisburg, both of Fed. Rep. of Germany

[21] Appl. No.: 9,809

[22] Filed: Feb. 2, 1987

[30] Foreign Application Priority Data

Feb. 3, 1986 [DE] Fed. Rep. of Germany ..... 3603190

[51] Int. Cl.[4] ..... B22D 11/08

[52] U.S. Cl. ..... 164/426; 164/446

[58] Field of Search ..... 164/425, 426, 445, 446

[56] References Cited

U.S. PATENT DOCUMENTS

| | | | |
|---|---|---|---|
| 3,262,161 | 7/1966 | Andrzejak et al. | 164/425 |
| 3,653,427 | 4/1972 | Evans | 164/425 |
| 4,635,702 | 1/1987 | Kolakowski et a. | 164/435 |

FOREIGN PATENT DOCUMENTS

| | | | |
|---|---|---|---|
| 2135919 | 9/1984 | United Kingdom | 164/426 |

*Primary Examiner*—Kuang Y. Lin

*Attorney, Agent, or Firm*—Russell & Tucker

[57] ABSTRACT

Means are provided for connecting the proximal end of a dummy strip to the distal (i.e. leading) end of a strip casting, in which a throw-away element serving both as a connector and a heat sink for chilling the metal adjacent to the connector is removably mounted on the proximal end of the dummy strip, with a slightly resilient sealing element holding both the dummy strip and the connector-heat sink element centrally of the mold cavity, and with the connector-heat sink spaced from the walls of the mold by a narrow gap and also having means for both chilling and positively interlocking with the metal of the distal end of the cast strip when it congeals.

10 Claims, 2 Drawing Figures

APPARATUS FOR CONNECTING A DUMMY STRIP TO THE LEADING END OF A CASTING IN THE START-UP OF CONTINUOUS CASTING OF STRIP METAL

FIELD OF THE INVENTION

This invention relates to the continuous casting of metal, especially steel, strip, and more particularly to mechanisms employed in the start-up of teeming and for guiding the passage of the front end of a cast metal strip out of the casting mold and through the supporting rolls of a cooling zone and pinch rolls. Still more particularly the invention relates to a novel connection head for attachment to the end of a dummy strip employed in initiating the withdrawal of a continuously cast metal strip from a strip casting mold.

BACKGROUND OF THE INVENTION

Dummy plugs used for the start-up of teeming in the continuous casting of various metal shapes are well known as is also the use of a removable connection head for such dummy plugs generally employing a packing strip or cord made of plastic covered with scrap for cooling, to seal the gap between the connection head and the walls of the mold. For example, Austrian Patent AT PS No. 352,924 describes a dummy bar head which uses a seal supported by a spring plate which is pushed into grooves in the upper surface of the head of the dummy bar. This seal automatically closes off the gap between the connection head and the mold walls, but is not particularly effective because it also can be burnt out by the molten metal at the start of casting with the result that metal can penetrate into the gap between the dummy bar and interfer with the withdrawal action. The risk of a freeze-up at the critical movement of the initiation of teeming can be minimized by the use of cooling scrap, but to do so is cumbersome. In addition, cleaning out the grooves in the connection end of the dummy bar is costly and time consuming.

Another known device described in European Patent No. 114,309 employs a removable connection head on the end of a dummy bar which can be attached to the dummy bar before insertion into the casting mold. The connection head is provided with a seal held by a seal holder which is covered and temporarily protected. At the start-up of teeming the seal is vaporized and dissolved by the molten metal as it enters the mold. This arrangement, however, also has the drawback of requiring the use of cooling scrap which introduces the risk of scratching the inner surfaces of the mold and of the supporting guides for the casting further downstream. Also the seal holder has to be replaced after each start-up.

In addition due to the narrow shape and thin cross-section of strip metal and the consequent poor accessability and constricted room, these known types of connection heads are not suitable for use in the continuous casting of strip metal, especially steel.

It is therefore an object of this invention to provide a connection head for use with a dummy strip in the initiation of teeming in the continuous casting of strip metal, which connectin head can be mounted on the end of the dummy strip outside of the mold in a quick, simple and exact manner to form an efficient and effective seal without requiring the use of cooling scrap.

BRIEF DESCRIPTION OF THE INVENTION

These and other objects of an illustrative embodiment of the invention are achieved by detachably mounting a gasket made of refractor material on the proximal end of a dummy strip, and with the gasket having a short border extending laterally sufficiently snugly to press against the walls of the mold. Covering the gasket and holding it in place is a flat vertically oriented plate spaced from the walls of the mold by a uniform narrow gap the width of which gap is referred to herein as dimension A. The plate is formed so as to provide upwardly extending projections having enlarged heads (in profile) on it, and with means for removably attaching it to the proximal end of the dummy strip. An intermediate plate can also be used between the gasket and the vertically oriented plate. Conveniently the attaching means comprises machine screws extending through the plate, through the gasket and into slotted recesses in the proximal end of the dummy strip.

It is a feature of the invention that the gasket and the plate can be mounted on the end of the dummy strip at one and the same time, and that the screw connections ensure precise location and centering of the parts so that the sealing edge of the gasket fits accurately within and in snug contact with the walls of the mold and so that the gap between the plate and the walls of the mold is uniform around the plate. Due to the relatively large specific heat of the plate, when the molten metal reaches it at the start of the casting operation, the molten metal rapidly cools and congeals adjacent to the plate. This ensures a rapid and secure connection between the connection head and the metal of the cast strip. In addition, the rapid cooling tends to deter the passage of the molten metal downwardly in the gap between the vertically oriented plate and the walls of the mold and thereby reduces both the temperature of the molten metal when it reaches the gasket and its fluid pressure. This effectively protects the gasket and makes it possible to reuse it.

In addition a feature of the invention is that the penetration of metal into the gap between the vertically oriented plate and the walls of the mold does not bring about a jamming or freezing of the mold because the metal in the gap contracts on cooling and pulls away from the mold wall. Normally in continuous casting a separation of the metal from the walls of the mold is undesireable because of the reduction of heat transfer rate caused thereby, but in this case it is not a disadvantage because that portion of the strip which lies adjacent to the vertically oriented steel plate and is discarded to scrap anyway.

A further feature of the invention is that the gasket may be made of ceramic fibers. Another feature is that the lateral dimensions of the plate are approximately the same as those of the dummy strip. Still another feature is that the dimension of the gap A is between about 5 mm and 15 mm. A further feature is that the upwardly extending projections on the vertically oriented plate have a profile in the form of enlarged, mushroom-like heads. This ensures good gripping action between the connection head and the casting, and also, being in flat profile, it is easier to fabricate by flame cutting. A still further feature is that the vertically oriented plate is connected to the proximal end of the dummy strip by screws fitting into transverse slots which are open along one lateral face of the dummy strip. This permits quick removal of the dummy strip from the connection head after use, and thereafter quick removal of the gasket and its support plate from the vertically oriented plate, to prepare them for reuse.

BRIEF DESCRIPTION OF THE DRAWINGS

Illustrative embodiments of the invention are shown in the accompanying drawings in which.

DETAILED DESCRIPTION OF THE INVENTION

Figure 2:
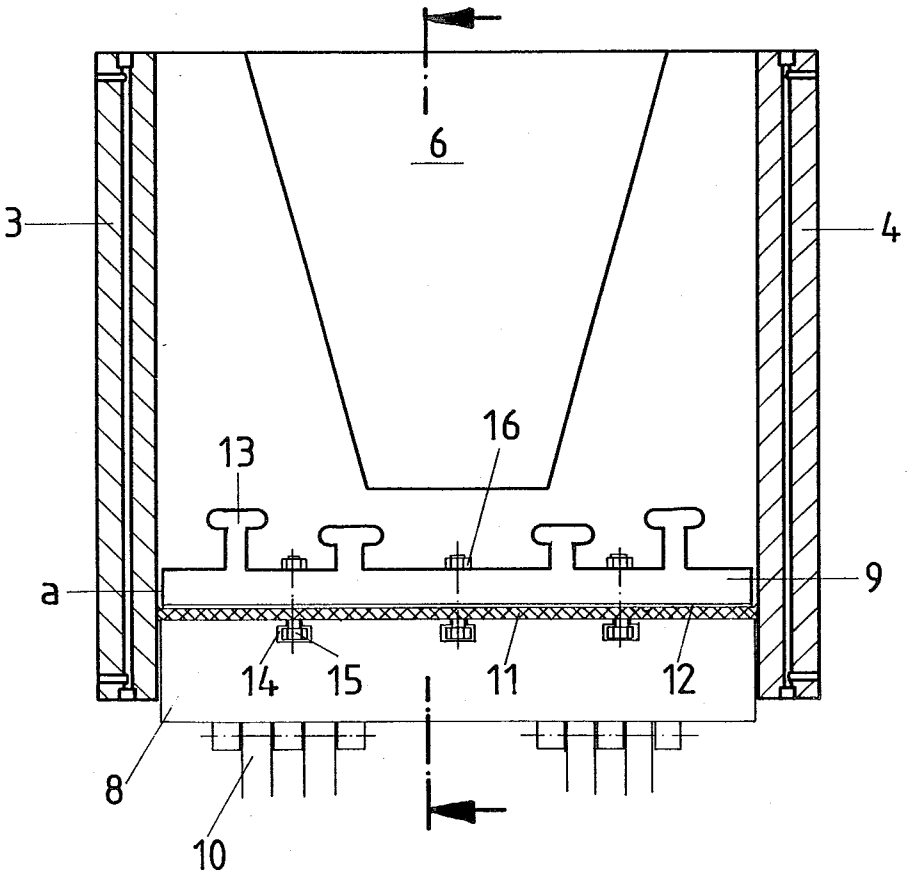
FIG. 2 is a cross-sectional view in end elevation of the mold of FIG. 1.
Figure 1:
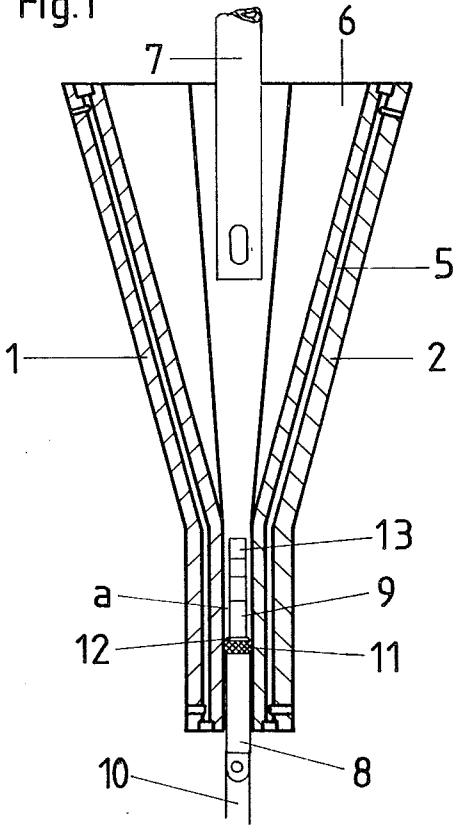
FIG. 1 is a cross-sectional view in side elevation of a mold for continuously casting strip metal showing a dummy strip and connection head according to the invention in position for the start-up of teeming, in the exit end of th mold.

The illustrative embodiment of the invention herein shown comprises a continuous casting mold for strip metal, especially steel, defining a narrow cavity having respectively opposite broad side walls 1,2 and narrow side walls 3,4, each of which is provided with internal ducts 5 for cooling. The upper portion of the mold is flared to provide an enlarged teeming zone 6 into which a teeming tube 7 is inserted. The enlarged teeming zone 6 necks down to the eventual cross-sectional configuration of the strip being cast. From there to the exit (distal) end of the mold the casting passes through a distal zone having parallel walls.

In order to provide a plug in the distal end of the mold during the start-up of teeming, and to provide a connection by means of which the cast metal strip can be led through the cooling zones, supporting rolls, and pinch rolls downstream of the mold, a short dummy strip or plug 8 having the cross-sectional shape and dimensions of the eventual strip, is placed in the distal end of the mold. After the start of teeming, the dummy strip 8 is drawn out of the mold further downstream by traction and supporting means, for example, chains 10. In order to prevent the molten metal from reaching the dummy strip 8 on start-up, a refractory gasket 11 (preferrably of ceramic fiber) is mounted on the proximal end of the dummy strip 8, said gasket 11 having a laterally extending lip which extends around all edges of the dummy strip 8 and engages the mold wall with a snug fit. The gasket 11 is held in place by means of a thin flat plate 12 oriented transverse to the axis of flow, over which lies a vertically (axially) oriented plate 9, fixed to the proximal end of dummy strip 8 through plate 12 and gasket 11 by means of machine screws 15. The plate 9 is cross-sectionally shaped and dimensioned so that its axially extending side walls are parallel to the walls of the mold in the distal zone, and spaced therefrom substantially uniformly around by a dimension A which may preferrably be between about 5 and 15 mm. In addition, the upper or proximal end of the plate 9 is formed with a plurality of projections 13 having enlarged heads in profile so as to provide a firm mecanical connection between the plate 9 and the casting. The machine screws 15 which hold the vertially oriented plate 9 and the gasket 11 in place on the proximal end of the dummy strip 8 fit into slots 14 in the end of the strip 8 which slots have open ends along one lateral face of strip 8 so that the screw heads can be moved laterally to disengage the vertically oriented plate 9 from the dummy strip 8 after use.

The operation of the dummy strip and connection head combination of the invention is as follows. When teeming starts, the molten metal flows immediately into contact with the vertically oriented plate 9 around projections 13, and down into the gap between the plate 9 and the parallel walls of the mold. The specific heat of the plate 9 (which serves in effect as a heat sink as well as a connector) and the surrounding mold walls rapidly reduces the temperature of the metal and retards its flow into the gap. Depending upon the dimension A of the gap, the metal may or may not reach the gasket 11. In fact, the optimum dimension for the gap A is selected so that the metal barely reaches the gasket 11. In practice, it has been found that a dimension of 7 mm is optimal, but successful operation is feasible substantially above and below that value. Shortly after the start of teeming, the dummy strip 8 is withdrawn and leads the cast strip through cooling zone supporting rolls, and pinch rolls downstream, after which the connection head and dummy strip are severed from the end of the casting. After severence, the plate 9 is disengaged from the end of the dummy strip 8 by sliding the machine screw heads laterally in slots 14. Thereafter the gasket 11 and cover plate 12 can be removed from the bottom edge of plate 9, and the scrap steel cut away from the plate 9.

It should be noted that an important cooperative relationship exists between the elements of the combination. Thus, the gasket 11, anchored as it is, symetrically of the dummy strip 8 and having a margin extending uniformly around the top end of the dummy strip 8 which margin snuggly engages the walls of the mold, holds the dummy strip accurately in the correct position in the mold. In addition, plate 9 is likewise held symetrically and evenly spaced from the mold walls by the gasket 11. This is especially important in that it ensures that the flow of molten metal into the gap between plate 9 and the walls of the mold will be uniform. Because of this interrelationship, the dimension A can be reduced to a point where the gasket is effectively protected from the molten metal without any substantial risk that more metal will flow into the gap at one point than at any other point.

Having described an illustrative embodiment of our invention, various modifications or adaptations thereof will now be apparent to those skilled in the art. For example, the exact shape of the projections 13 is not critical provided they make an effective mechanical connection between the casting and the connection head. Likewise the precise location and shape of the gasket can be changed. Thus, the gasket 11 could ring the lower end of plate 9 instead of being mounted as a mat on the end of dummy strip 8, and function equally well provided the axial dimension of the axially extending walls of the plate 9 is sufficient to achieve the desired cooling and retardation of the molten metal flowing into the gap. In addition, the walls of the plate 9 need not be flat, but can instead be provided, for example, with horizontally extending recesses to maximize the transfer rate of the heat from the melt into the plate and thereby more rapidly and effectively retard the downflow of the metal. This also increases the positive lock between the connector and the melt, but since the plate 9 is a throw-away item, this is not a disadvantage. Further, the precise material employed for the gasket can be varied as long as a reasonably snug fit is obtained between the gasket and the mold walls so as to maintain the important interrelationship of the components. Accordingly, it is not our intention to restrict the invention to the precise form herein shown, but rather to limit it solely in terms of the appended claims.

We claim:

1. Combined apparatus for the start-up of teeming for continuously casting strip metal comprising a mold shaped for continuously casting metal strip, said mold having a distal zone in which a proximal end of a dummy strip lies during start-up said distal zone of said mold having respectively opposed narrow and broad side walls lying in substantially parallel relation, said apparatus further comprising:

means for connecting the leading end of a cast strip to said dummy strip comprising a heat sink element having a proximal edge lying in a plane generally normal to the longitudinal axis of said dummy strip and having the approximate cross-sectional shape of, but smaller than the strip being cast and means for connecting said heat sink element to the proximal end of said dummy strip, said heat sink element also having axially extending sides and ends defining a narrow gap between the heat sink and the parallel walls of said mold when said dummy strip is in said zone during start-up, so as to extract heat from molten metal poured into said gap, in two directions, means operatively associated with said heat sink element for positively interlocking with said cast strip, and means operatively associated with said heat sink element located substantially downstream of the proximal edge of said heat sink element dimensioned to fit snugly within the distal zone of said mold and against the parallel walls thereof, for holding said heat sink element accurately centered within the distal zone of said mold when said dummy strip is lodged therein during start-up and to make the dimension across the narrow gap substantially uniform during start-up.

2. The apparatus defined in claim 1 further characterized by:

said heat sink element comprising a metal plate.

3. The combination defined in claim 1 further characterized by:

said means for positive locking located on the proximal side of the proximal edge of said heat sink element also comprising heat sink material and having axially extending sides defining a narrow gap between it and the parallel walls of said mold when said dummy strip is in said mold during start-up;

whereby heat from molten metal poured into the distal zone of said mold and into the narrow gap between said positive locking means and said walls is extracted from said molten metal in two directions to congeal same and form said positive lock rapidly.

4. Combined apparatus for the start-up of teeming for continuously casting strip metal, comprising:

a mold shaped for continuously casting metal strip, said mold having a distal zone in which respectively opposed narrow and broad side walls lie in substantially parallel relation, a dummy strip the proximal end of which is lodged in said distal zone at the start of teeming, means for connecting the leading end of a cast strip to said dummy strip comprising a flat plate of the approximate cross-sectional shape of but smaller than the strip being cast connected to the proximal end of said dummy strip spaced from said mold by a narrow axially extending gap, said plate also having means for mechanically interlocking with said cast strip when the metal thereof congeals adjacent to said plate, heat sink means operatively associated with said plate for extracting heat from the molten metal of said casting in two directions in said narrow gap, i.e., into said mold and into said heat sink means, for reducing the temperature and flow rate of molten metal flowing into the gap between said plate and said mold when said dummy strip and plate are located in said mold during start-up, and means also operatively associated with said plate located in the distal area of said gap dimensioned to fit snugly within the walls of said mold and hold said plate accurately and symmetrically centered in said mold during start-up comprising slightly resilient inert material for forming said gap.

5. The combination defined in claim 4 further characterized by:

both said plate and said inert material constructed and arranged to maintain the dimension of said gap uniformly around said plate between about 5 and 15 mm.

6. The combination defined in claim 5 further characterized by:

means for connecting said plate to the proximal end of said dummy strip with said inert material positioned and held in between.

7. The combination defined in claim 6 further characterized by:

means for releasing the connection means between said plate and said dummy strip after completion of the start-up.

8. The combination defined in claim 4 further characterized by:

said inert material comprising a fibrous refractory.

9. The combination defined in claim 4 further characterized by:

said means for holding said plate accurately centered, also for sealing the distal end of said gap against further passage of molten metal downstream.

10. The combination defined in claim 4 further characterized by:

said means for mechanically interlocking with said cast strip comprising an extension of said plate having projections with enlarged heads in profile.

* * * * *